US010381727B2

(12) United States Patent
Chen

(10) Patent No.: US 10,381,727 B2
(45) Date of Patent: Aug. 13, 2019

(54) MULTI-BAND ANTENNAS

(71) Applicant: HEWLETT-PACKARD DEVELOPMENT COMPANY, L.P., Houston, TX (US)

(72) Inventor: Ju-Hung Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 19 days.

(21) Appl. No.: 15/542,903

(22) PCT Filed: Apr. 30, 2015

(86) PCT No.: PCT/US2015/028420

§ 371 (c)(1),
(2) Date: Jul. 11, 2017

(87) PCT Pub. No.: WO2016/175816

PCT Pub. Date: Nov. 3, 2016

(65) Prior Publication Data

US 2018/0040957 A1 Feb. 8, 2018

(51) Int. Cl.

| | |
|---|---|
| ***H01Q 1/38*** | (2006.01) |
| ***H01Q 5/371*** | (2015.01) |
| ***H01Q 13/10*** | (2006.01) |
| *H01Q 1/22* | (2006.01) |
| *H01Q 1/24* | (2006.01) |

(52) U.S. Cl.

CPC ..... *H01Q 5/371* (2015.01); *H01Q 1/38* (2013.01); *H01Q 13/10* (2013.01); *H01Q 1/2266* (2013.01); *H01Q 1/241* (2013.01)

(58) Field of Classification Search

CPC ..... H01Q 13/10; H01Q 1/38
See application file for complete search history.

(56) References Cited

U.S. PATENT DOCUMENTS

| | | | | |
|---|---|---|---|---|
| 2008/0174511 | A1 | 7/2008 | Kim et al. | |
| 2008/0204340 | A1* | 8/2008 | Kim | H01Q 1/243 343/770 |
| 2009/0066596 | A1* | 3/2009 | Fujishima | H01Q 1/243 343/767 |
| 2011/0241950 | A1 | 10/2011 | Milosavljevic et al. | |
| 2011/0291902 | A1 | 12/2011 | Bafrooei et al. | |
| 2012/0176292 | A1 | 7/2012 | Hung et al. | |
| 2012/0218156 | A1 | 8/2012 | Mohammadian | |
| 2015/0054701 | A1 | 2/2015 | Kim et al. | |

OTHER PUBLICATIONS

Dastradj, A. et al.; "Broadband Coplanar Waveguide-fed Wide-slot Antenna"; Aug. 3, 2010; 13 pages.
Nikoleou, S. et al.; "Shorted Annular Slot Antenna (ASA) Matched at Three Different Frequencies"; Jan. 19, 2005; 4 pages.

* cited by examiner

*Primary Examiner* — Graham P Smith
(74) *Attorney, Agent, or Firm* — HPI Patent Department

(57) ABSTRACT

An example discloses a slot antenna. The slot antenna includes: a cover including a slot; and an antenna PCB including a feeding line across the slot. The antenna PCB is coupled with the cover through a positive feeding terminal of the feeding line. The slot is closed at its one width side within the cover. A length of the feeding line is larger than a width of the slot.

14 Claims, 17 Drawing Sheets

MULTI-BAND ANTENNAS

BACKGROUND

With the speedy development of a radio technology, increasing numbers of radio devices are emerging in the market. The radio devices can be manufactured to realize radio communication with different frequency bands through antennas. In general, different radio devices are provided with different antennas of different frequency bands. The different antennas provide different frequency bands via different technologies.

BRIEF DESCRIPTION OF THE DRAWINGS

The disclosure is described in detail in the following description in conjunction with the drawings. Features of the present disclosure are illustrated by way of non-limiting examples, in which.

Throughout the drawings, identical reference numbers designate similar, but not necessarily identical, elements.

DETAILED DESCRIPTION

In the following detailed description of examples of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Figures 1A, 1B:
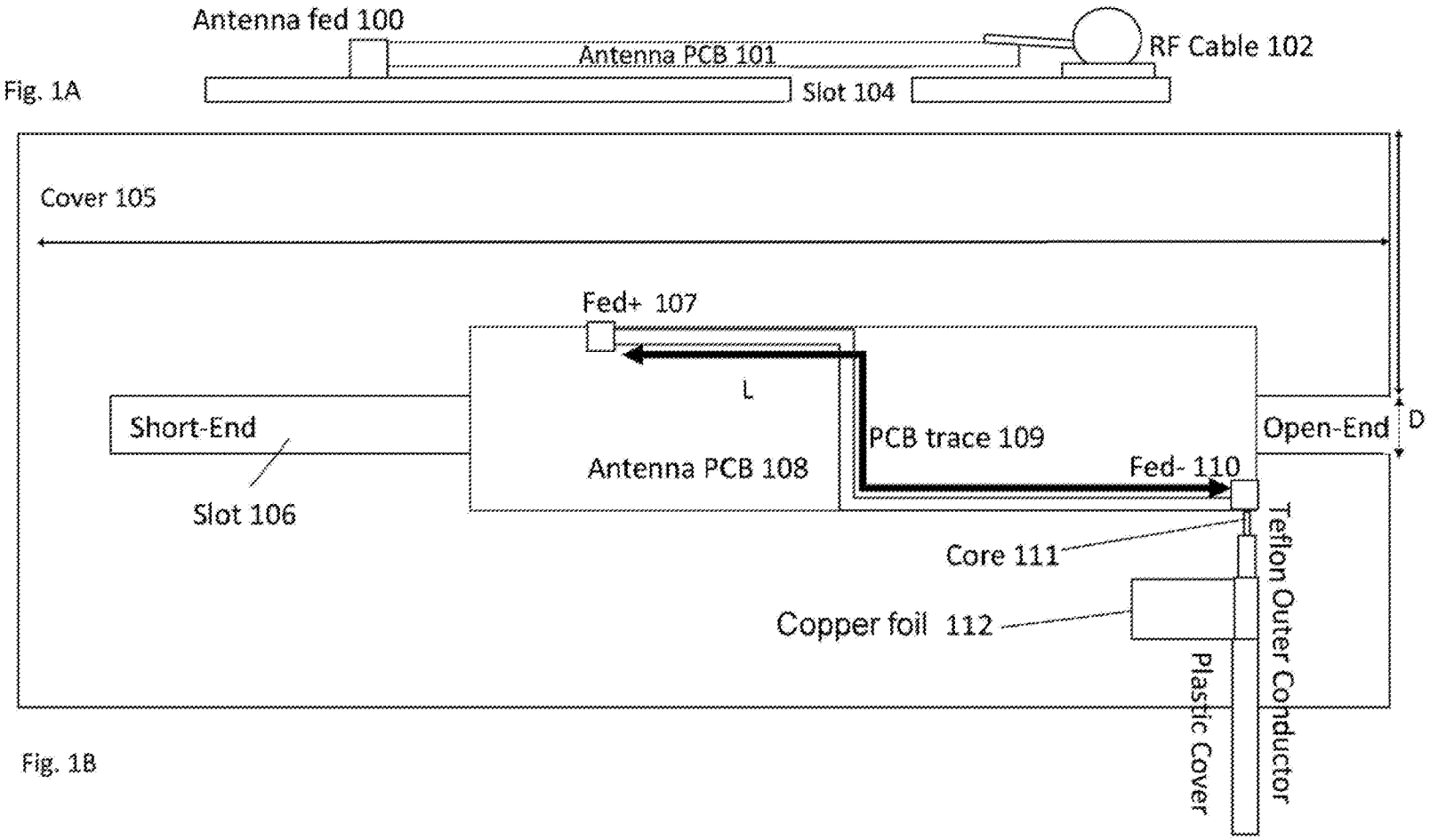
FIG. 1A is a side view of an example slot antenna according to the disclosure.
FIG. 1B is a vertical view of an example slot antenna according to the disclosure.

FIG. 1A is a side view of an example slot antenna according to the disclosure; and FIG. 1B is a vertical view of an example slot antenna according to the disclosure.

In FIG. 1A, the example slot antenna includes an antenna Printed Circuit Board (PCB) 101 and a cover 103. The cover 103 includes a slot 104. The antenna PCB 101 is coupled to a radio frequency (RF) cable 102 at its one side and is coupled to the cover 103 at its another side (antenna feeding terminal 100) through an electrical contact. The RF cable 102 is also coupled to the cover 103 as its ground through the electrical contact. In an example, the antenna PCB 101 may be located closely to the cover 103 so as to reduce the dimension of the antenna. The antenna PCB 101 is located over the cover 103.

In FIG. 1B, the slot 106 may be located between two length sides of the cover 105. The length and width sides of the slot 106 may be parallel to the length and width sides of the cover 105, respectively. The term "parallel" in this disclosure may encompass substantially parallel and entirely parallel. The term "substantial" may encompass some insignificant minute amount of variation. In another example, the slot 106 may be tilted by a certain angle with respect to the width side of the antenna PCB. This may apply to any other examples according to the disclosure. The slot 106 is open at its one width side, which is called an open end, and has a certain distance from its another width side to the width side of the cover 105 opposite to the open end of the slot 106, which is called a short end. The slot 106 may be rectangular. The slot 106 has a width D and may look narrow as a whole for example. In an example, the slot 106 may be rectangular. The length of the slot 106 is by far larger than its width. The length and width sides of the antenna PCB 108 may be parallel to the length and width sides of the slot 106.

The antenna PCB 108 includes the positive feeding terminal (Fed+) 107, the negative feeding terminal (Fed−) 110 and the feeding line of PCB trace 109 connecting the positive and negative feeding terminals. The feeding line has a total length L from Fed− 110 to Fed+ 107. The antenna PCB 108 is coupled to the cover 105 at its positive feeding terminal 107 and is coupled to the RF cable through a copper core 111 of the cable to receive and transmit a signal. The copper core 111 of the cable is surrounded by an insulated material, for example, Teflon. The insulated material is used to insulate the copper core 111 from the conductive layer of the cable, for example, a copper foil. The cable is covered by the outer plastic cover. The cable may operate as an outer conductor. The copper foil layer 112 of the cable is coupled to the cover 105 as a ground.

In the example, the PCB trace as the feeding line may include three line segments which operate together. The first line segment starts from the negative feeding terminal 110 and is parallel to the length side of the antenna PCB 108 and the third line segment can be designed to keep a certain distance from the top and bottom sides of the antenna PCB 108, respectively. The first line segment of the feeding line is connected to the third line segment through a connection second line segment between them. The second line segment may be parallel to the width side of the antenna PCB 108. The second line segment runs across the slot 106. In another example, the second line segment may be designed to tilt towards the right or the left so that the total length of the feeding line becomes longer. In case that the area reserved for the slot antenna is limited, for example, because of a Y dimension of the cover being limited, the second line segment may be designed to tilt so that the feeding line with a longer length can be available. This may apply to any other examples of the slot antenna according to the disclosure. The first line segment and the third line segment may be located at the opposite two sides of the second line segment. The first line segment runs along the bottom side of the antenna PCB and the third line segment runs along the top side of the antenna PCB. The length L of the feeding line 109 is larger than the width D of the slot. In an example, the length L of the feeding line 109 is larger than 5 times the width of the slot 106 so that the multi-band characteristics will be clearer. In another example, the length L of the feeding line is between 5 to 80 times the width of the slot 106, for example, so that the better Planar Inverted F Antenna (PIFA) and slot resonances can be obtained.

In an example, the cable is a coaxial cable. In general, the cable may be any suitable cable with two signal terminals, one of which is coupled to the antenna PCB and the other of which is coupled to the cover 105. The cable 102 may be perpendicular to the first line segment of the feeding line 109. The term "perpendicular" in this disclosure may encompass substantially perpendicular and entirely perpendicular. Although the cable is shown to be perpendicular to the bottom side of the antenna PCB 108, it is not mandatory. As a matter of fact, the cable may be tilted towards the left or the right by a certain angle, depending on the area as reserved for the slot antenna. The cable is coupled to the antenna PCB 108 at the bottom right-hand corner of the antenna PCB 108 or at a point away from the bottom right-hand corner of the antenna PCB 108. The slot antenna as showed generates multi-band characteristics.

In an example, the frequency bands as generated by the slot antenna may be tuned by adjusting the PCB trace routing. In the example, the second segment may be designed to move towards the left or the right so that the frequency bands as generated by the slot antenna can be changed. The configuration described in this example is not limiting and may be applicable to other suitable scenarios.

In another example, the frequency bands as generated by the slot antenna may be tuned by adjusting the position of the positive feeding terminal of the feeding line based on PCB trace routing. For example, the Fed+ is positioned far away from the end point of the second segment or near to the end point of the second segment. The configuration described in this example is not limiting and may be applicable to other suitable scenarios.

Figure 2:
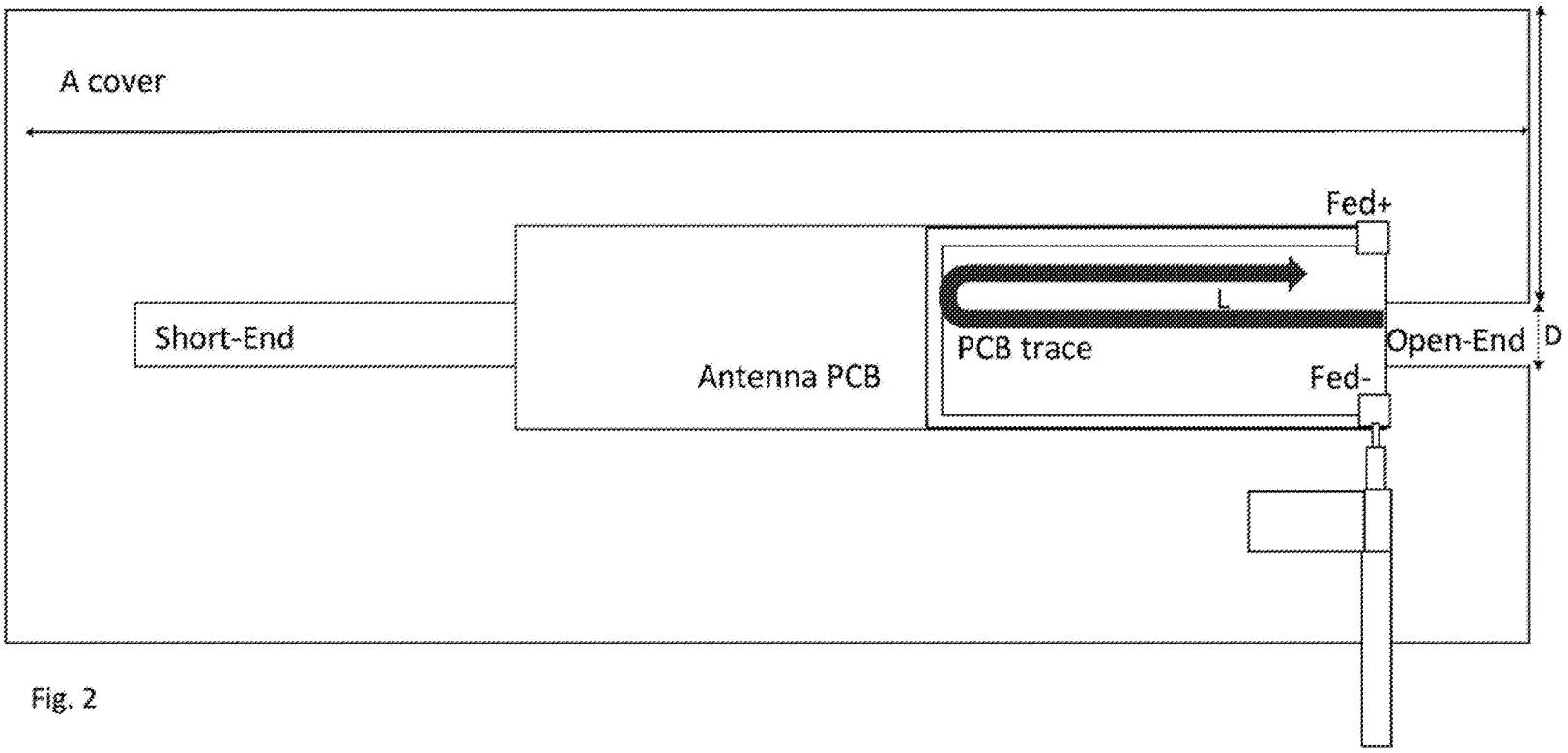
FIG. 2 is a diagram of an example slot antenna according to the disclosure.

FIG. 2 shows a diagram of an example slot antenna according to the disclosure. The example shown in FIG. 2 is similar to the one shown in FIG. 1 except for the PCB trace routing. In the example, the first line segment may be parallel to the third line segment and the negative Fed− and the positive Fed+ are located at two opposite sides of the slot and at the top and bottom right-hand corners of the slot. Both the first and third line segments are located in the same side of the second line segment. The first line segment runs along the bottom side of the antenna PCB and the third line segment runs along the top side of the antenna PCB. The length L of the feeding line has the similar relationship with the width of the slot to that of the feeding line in FIG. 1. In another example, the Fed+ is designed not to reach the top right-hand corner so that a different frequency band can be generated. Likewise, the second line segment may be designed to move towards the left or the right, depending on the desirable frequency bands.

Figure 3:
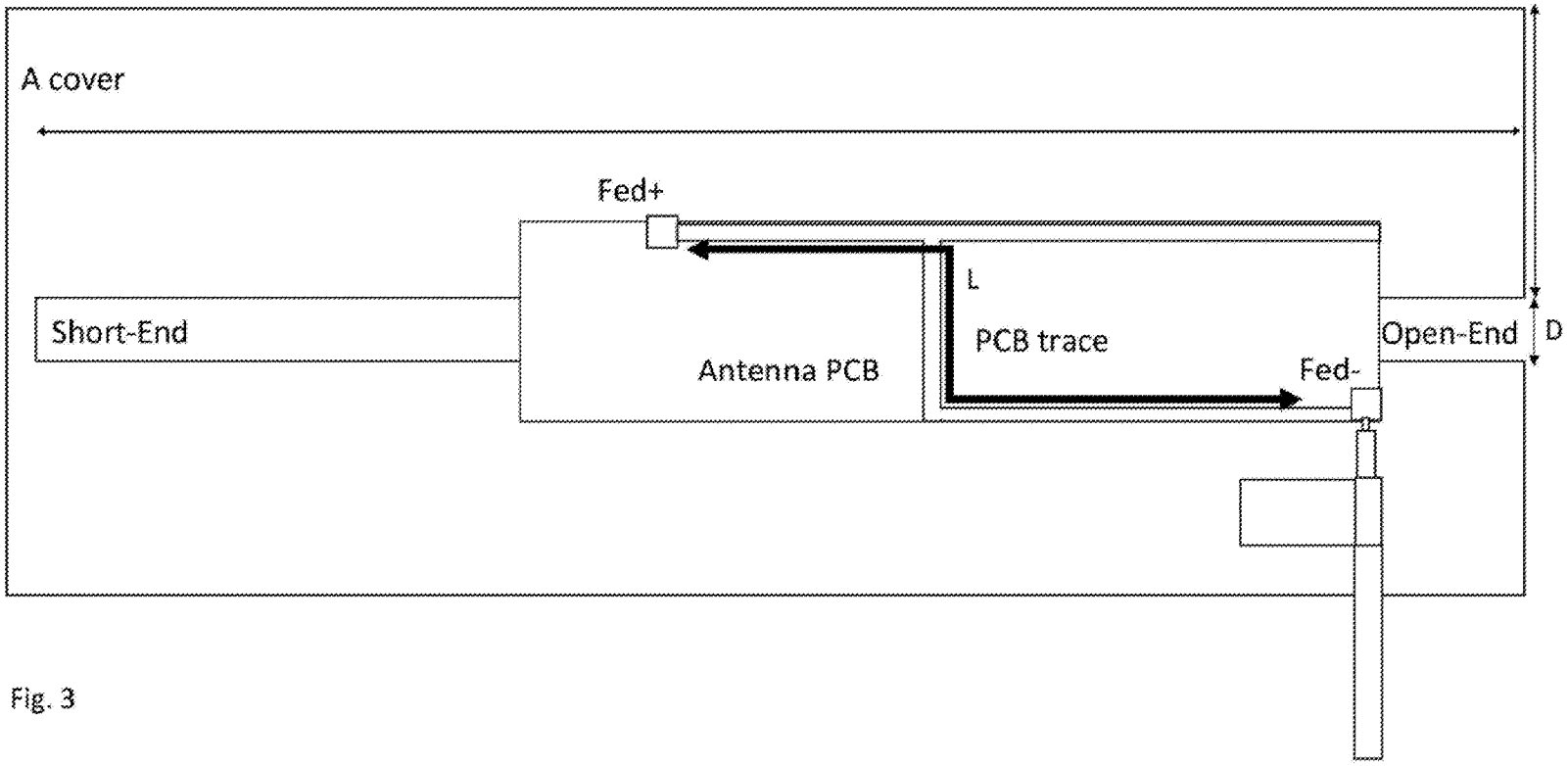
FIG. 3 is a diagram of an example slot antenna according to the disclosure.

FIG. 3 shows a diagram of an example slot antenna according to the disclosure. The example shown in FIG. 3 is similar to the one shown in FIG. 1 except for the PCB trace routing. In the example, the third line segment runs from the right side of the antenna PCB toward the left side of the antenna PCB along the top side of the antenna PCB. The third line segment includes two portions wherein the first portion runs from the right side of the antenna PCB to the intersection point of the third line segment with the second line segment and the second portion starts from the intersection point towards the left side of the antenna PCB, but does not reach the left side. The Fed+ is located at the left end of the second portion of the third line segment. The length of the feeding line refers to the total length of the first line segment, the second line segment and the second portion of the third line segment and starts from the Fed− to the Fed+.

Figure 4:
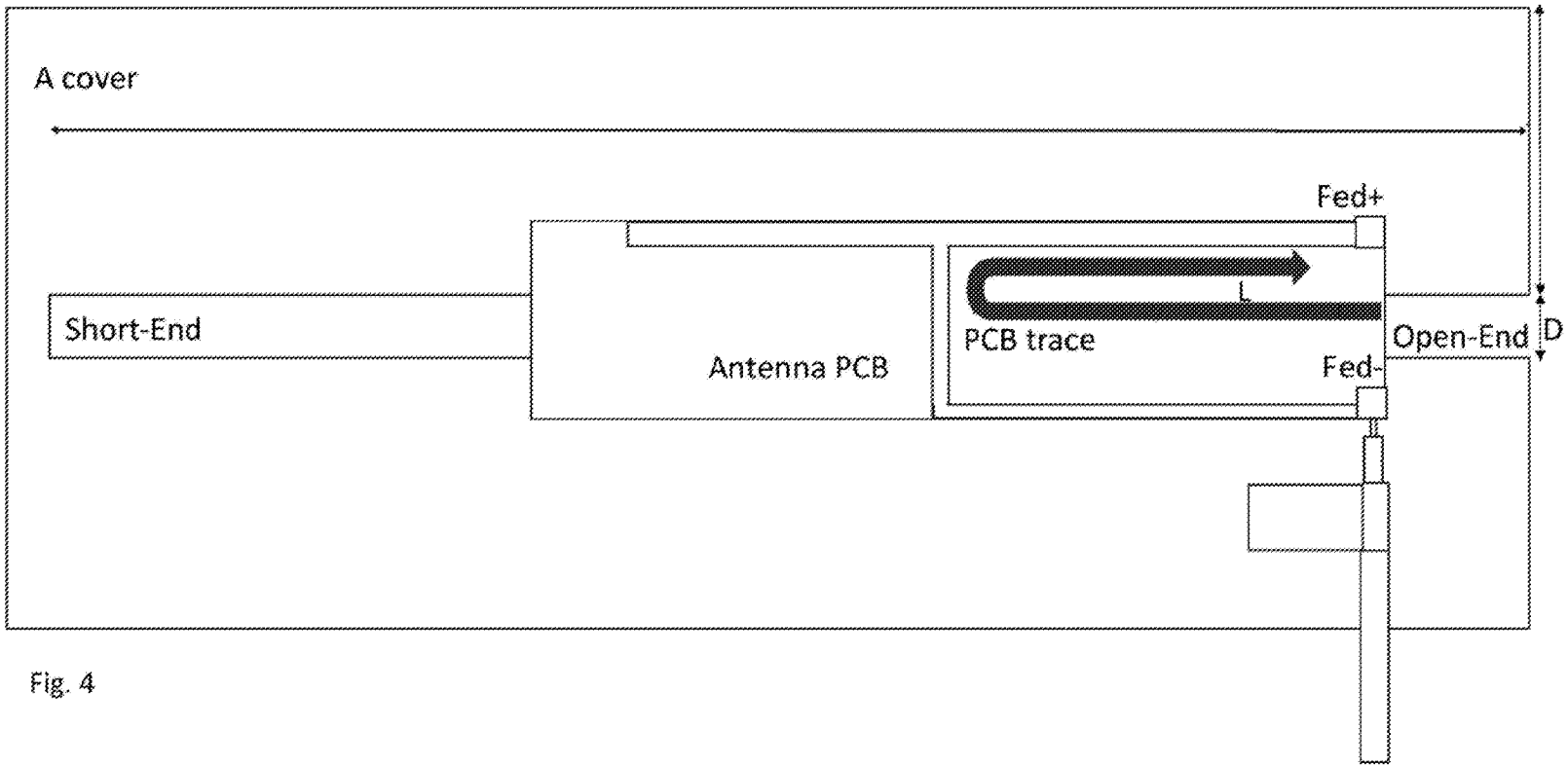
FIG. 4 is a diagram of an example slot antenna according to the disclosure.

FIG. 4 shows a diagram of an example slot antenna according to the disclosure. The example shown in FIG. 4 is similar to the one shown in FIG. 2 except for the PCB trace routing. In the example, the Fed+ is located at the right end of the first portion of the third line segment of the feeding line. The length of the feeding line refers to the total length of the first portion of the third line segment, the length of the second line segment and the length of the third line segment. In another example, the first and third line segments may partially overlap with the slot or partially go across the slot, depending on desired frequency bands. For example, the first line segment may be designed to extend upwards the top side of the antenna PCB at its right end and cross the bottom side of the slot but not reach the top side of the slot. In an example, the third segment may add an extension segment which starts from any point between the end point of the second segment and the right end of the second portion of the third segment and goes downwards and cross the top side of the slot but not reach the bottom side of the slot. The configuration described in this example is not limiting and may be applicable to other suitable scenarios.

Figure 5:
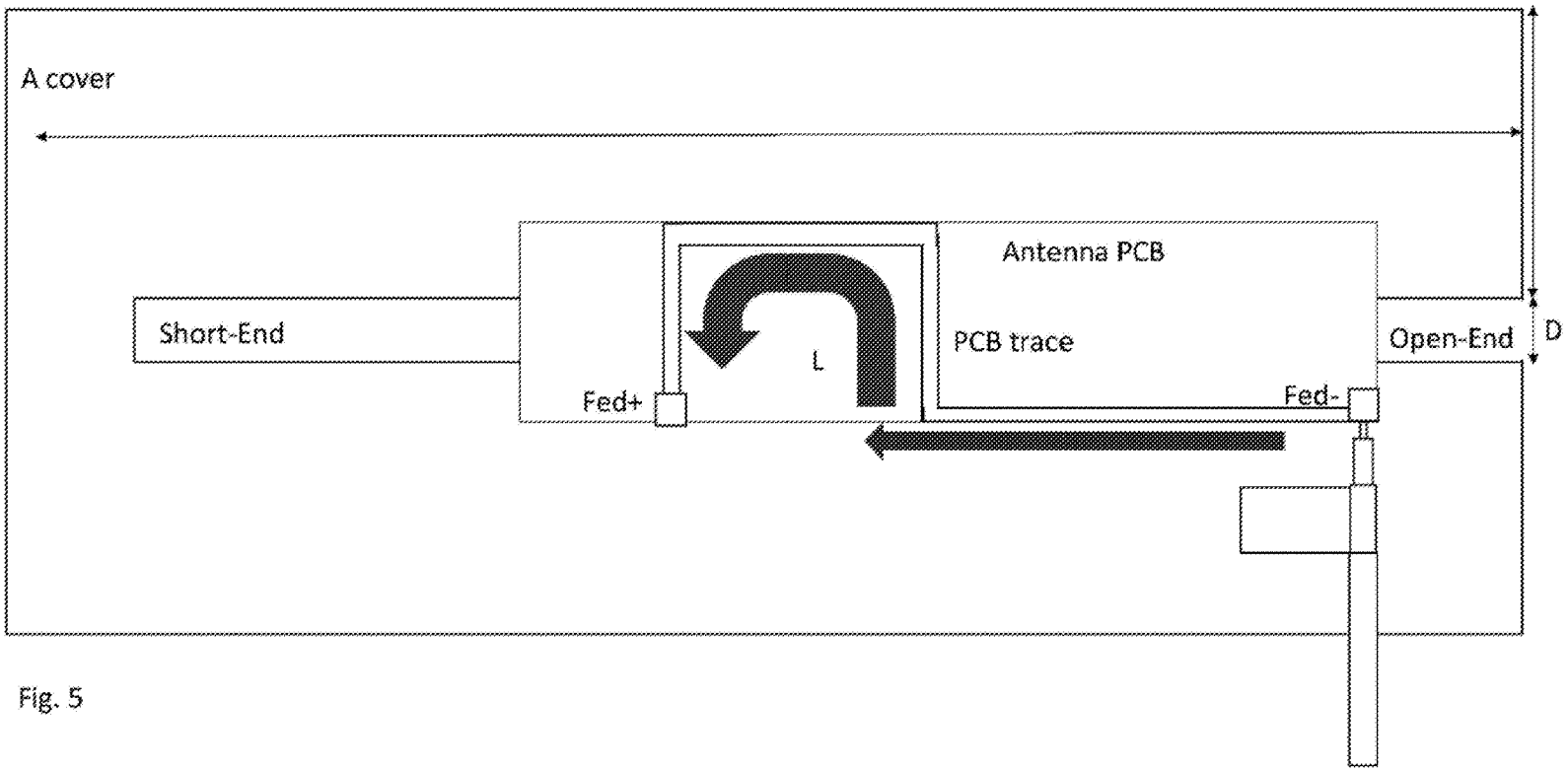
FIG. 5 is a diagram of an example slot antenna according to the disclosure.

FIG. 5 shows a diagram of an example slot antenna according to the disclosure. The example shown in FIG. 5 is similar to the one shown in FIG. 1 except for the PCB trace routing. In the example, the first, second, third line segments in FIG. 5 are the same as those in FIG. 1. The feeding line in FIG. 5 further includes the fourth line segment. The fourth line segment starts from the end of the third line segment and runs downwards the bottom side of the antenna PCB across the slot and reaches the bottom side. In an example, the fourth line segment may cross the top side of the slot, but not reach the bottom side of the slot. The fourth line segment may be parallel to the second line segment. In another example, the fourth line segment may be designed to tilt toward the left or right. In this example, the positive Fed+ and the negative Fed− are located at the same bottom side of the antenna PCB. The length of the feeding line refers to the total length for the first, second, third and fourth line segments from the Fed− to the Fed+.

Figure 6:
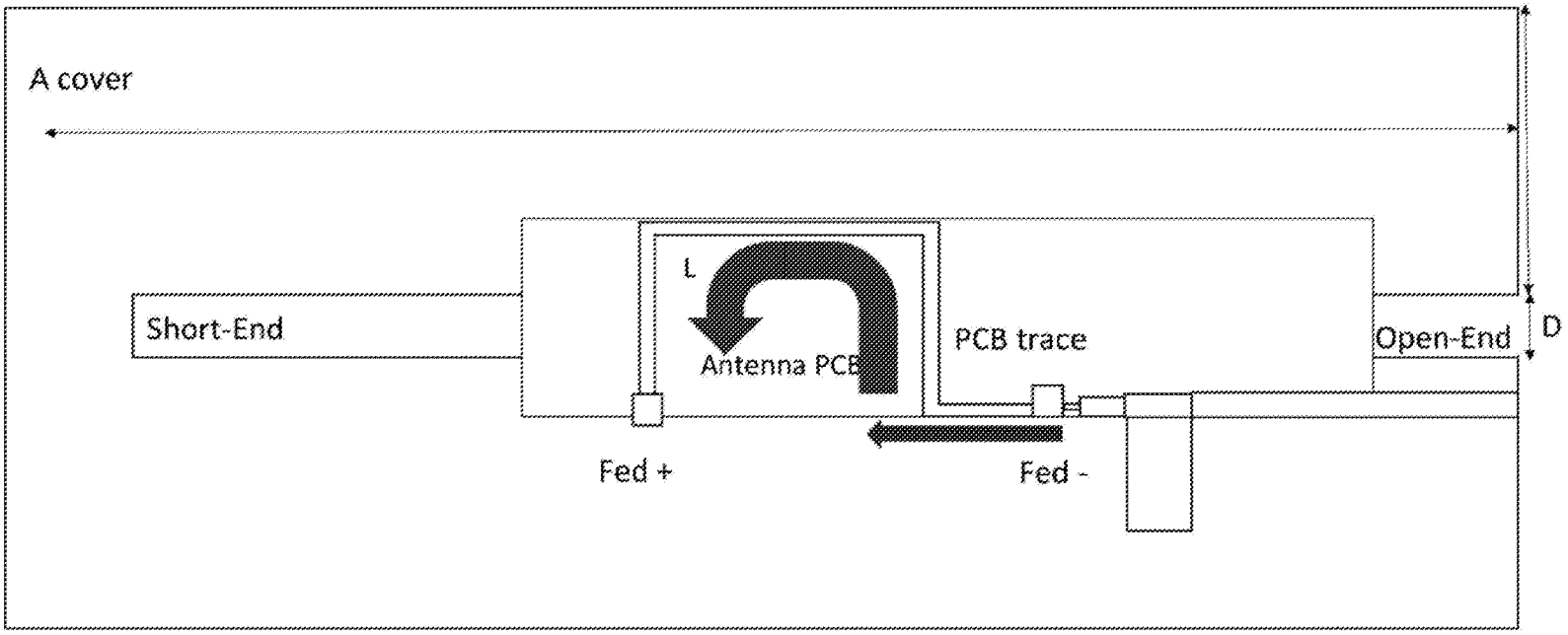
FIG. 6 is a diagram of an example slot antenna according to the disclosure.

FIG. 6 shows a diagram of an example slot antenna according to the disclosure. The example shown in FIG. 6 is similar to the one shown in FIG. 5 except for the PCB trace routing. In the example, the first line segment is shortened so that the negative Fed− is located between the starting point of the second line segment and the right side of the antenna PCB. In the example, the outer conductor runs along the bottom side of the antenna PCB and is parallel to the bottom side of the antenna PCB and is coupled to the shortened first line segment at the Fed−. The copper foil layer of the outer conductor is coupled with the cover as the ground. The length of the feeding line refers to the total length of the shortened first line segment, the second, third and fourth line segments from the Fed− to the Fed+.

Figure 7:
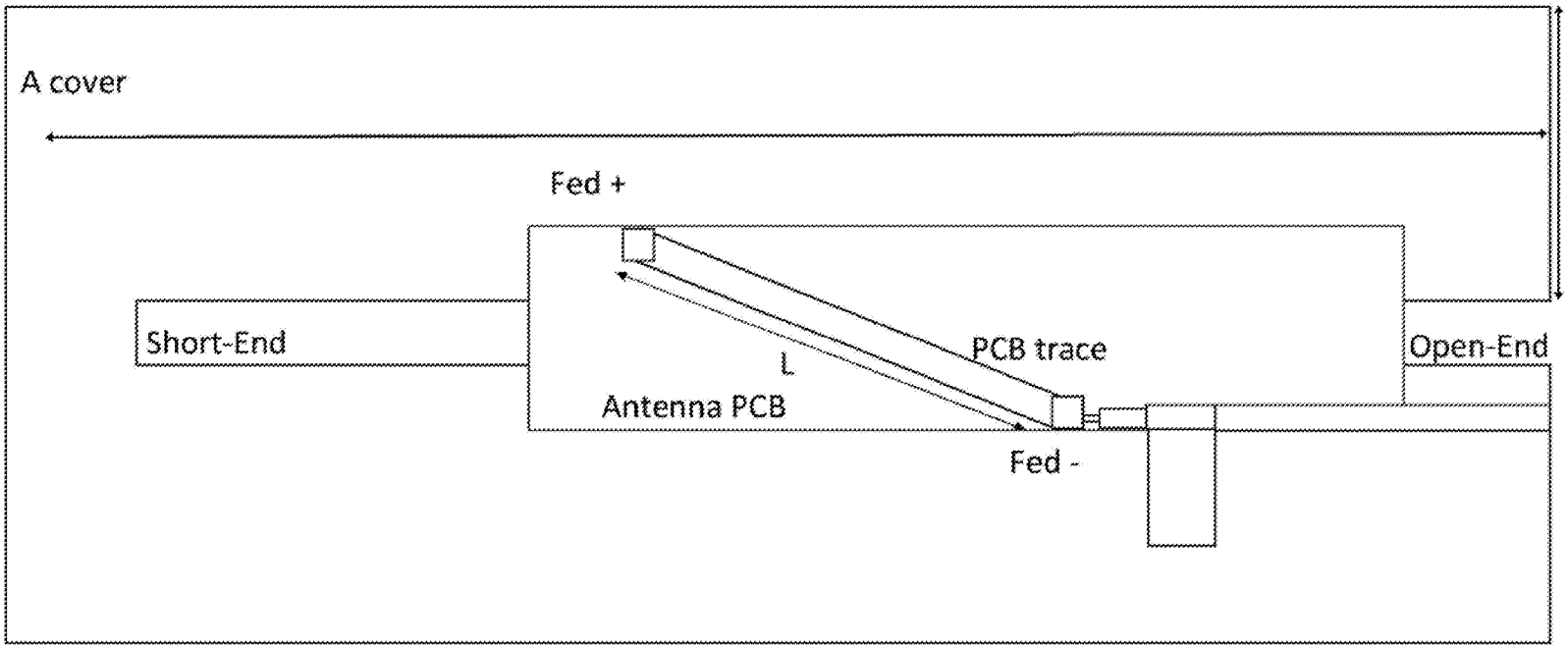
FIG. 7 is a diagram of an example slot antenna according to the disclosure.

FIG. 7 shows a diagram of an example slot antenna according to the disclosure. The connection manner and location of the outer conductor with the antenna PCB is similar to the one shown in FIG. 6 except for the PCB trace routing. In the example, the feeding line as the PCB trace is a direct line segment from the negative Fed− to the positive Fed+. The Fed− is located at the bottom side of the antenna PCB and the Fed+ is located at the top side of the antenna PCB. The direct line segment of the feeding line is tilted towards the left from the Fed−1 by an angle larger than 90°, so that the Fed+ is located at the top side of the antenna PCB and toward the left side of the antenna PCB with respect to the Fed−. In the case that the width of the cover or the width of the antenna PCB is limited, the tilting angel of the feeding line may be much larger, so that the length of the feeding line may be increased and thus the desired frequency bands may be generated. The length L of the feeding line is larger than 5 times the width D of the slot. In another example, the length L of the feeding line is between 5 to 80 times the width of the slot 106, so that the better PIFA and slot resonances can be obtained. The length L of the direct feeding line starts from the fed − to the fed +. In another example, the direct line segment of the feeding line is tilted towards the right from the Fed−1 by an angle less than 90°, so that the Fed+ is located at the top side of the antenna PCB and toward the right side of the antenna PCB with respect to the Fed−.

Figure 8:
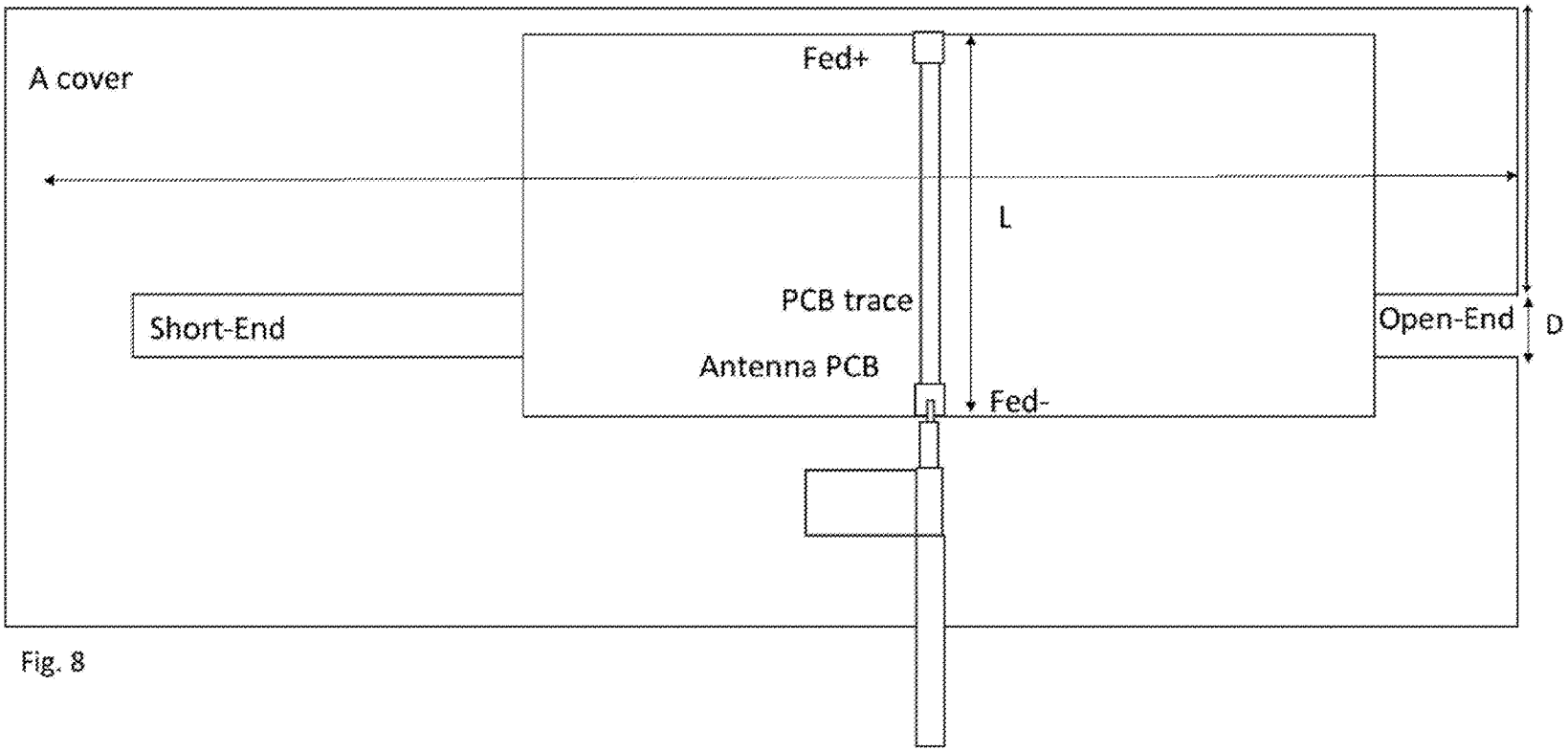
FIG. 8 is a diagram of an example slot antenna according to the disclosure.

FIG. 8 shows a diagram of an example slot antenna according to the disclosure. The outer conductor is coupled to the bottom side of the antenna PCB through the Fed− at the around middle point of the bottom side of the antenna PCB. The copper foil layer of the outer conductor is coupled to the cover as the ground. The outer conductor goes along the down extension direction of the feeding line and is parallel to the width side of the antenna PCB. The outer conductor is in the same line as the feeding line. The feeding line is a direct line segment across the slot and its Fed+ is located at the top side of the antenna PCB. In another example, the Fed+ is located at a point away from the top side of the antenna PCB. The Fed− is located at the bottom side of the antenna PCB. The feeding line from the Fed− to Fed+ is parallel to the width side of the antenna PCB. The portion of the feeding line above the top side of the slot goes forward to the top side of the cover. The length L of the feeding line is larger than 5 times the width of the slot. In another example, the length L of the feeding line is between 5 to 80 times the width of the slot 106 so that the better PIFA and slot resonances can be obtained.

Figure 9:
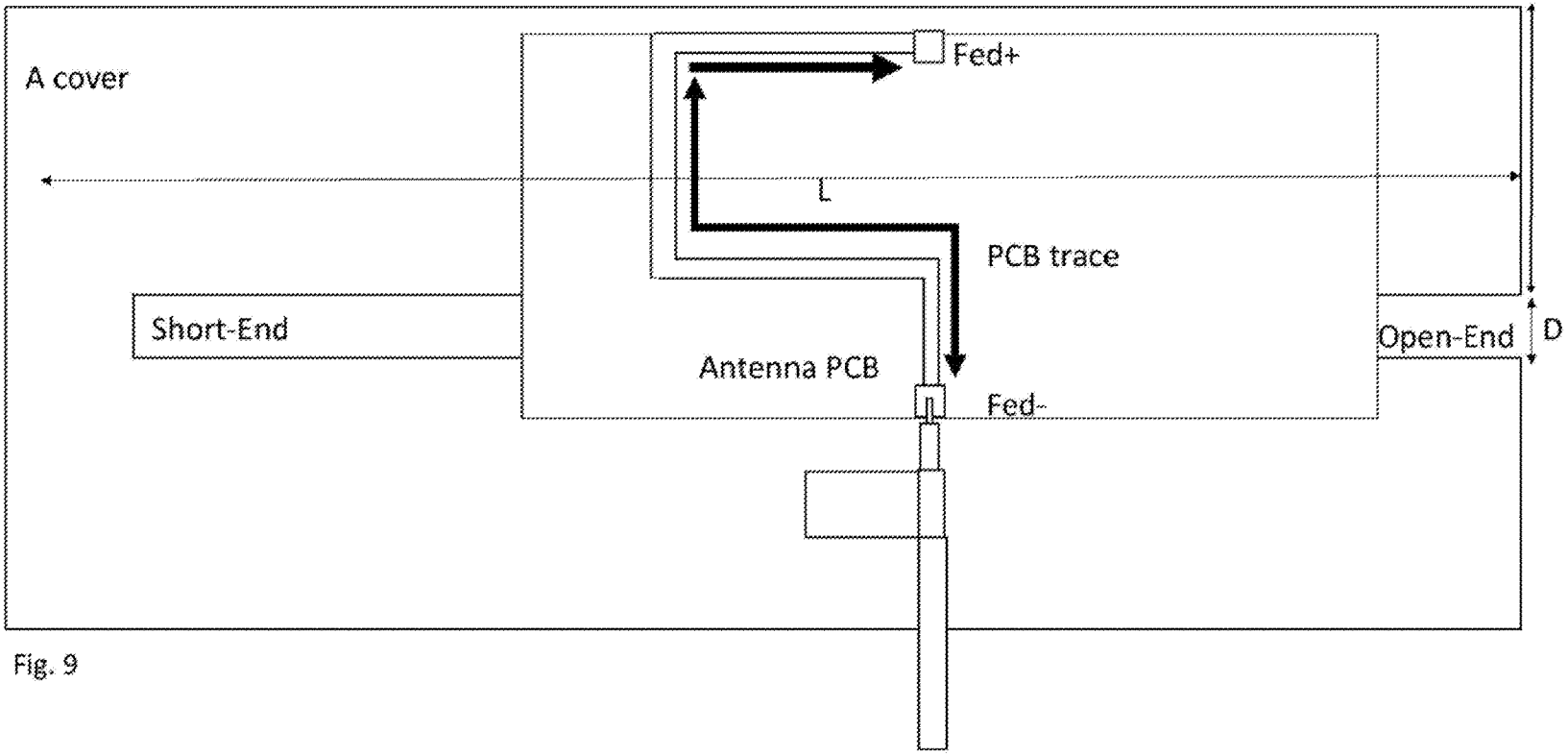
FIG. 9 is a diagram of an example slot antenna according to the disclosure.

FIG. 9 shows a diagram of an example slot antenna according to the disclosure. The outer conductor is coupled to the bottom side of the antenna PCB through the Fed− at around middle point of the bottom side of the antenna PCB. The copper foil layer of the outer conductor is coupled to the cover as the ground. The Fed+ of the feeding line is located at the top side of the antenna PCB. The feeding line consists of four line segments. The first line segment starts from the Fed− and goes upward across the slot. The second line segment starts from the upper end of the first line segment and goes towards the left but does not reach the left side of the antenna PCB by the length larger, equal or less than the length of the first line segment. The third line segment starts from the end of the second line segment and goes upward to reach the top side of the antenna PCB. The fourth line segment starts from the end of the third line segment to go towards right to reach the Fed+. The fed+ may be vertically in the same line as the Fed−. In another example, the fed+ may not be in the same line as the Fed+. The length L of the feeding line is larger than 5 times the width D of the slot. In the case that the example shown in FIG. 8 is limited by the width of the cover or the width of the antenna PCB, the example shown in FIG. 9 may replace the example shown in FIG. 8 so that the length of the feeding line may be increased to obtain the desired frequency bands.

In a case that the width of the cover or the width of the antenna PCB is limited, the length of the feeding line may be increased by increasing detours of the feeding line.

In the above examples, the feeding line is provided with one positive feeding terminal Fed+. In an example, the length L of the feeding line is larger than 5 times the width of the slot so that the dual wideband characteristic is evident. In another example, the length L is between 5 and 80 times the width of the slot so that the better PIFA and slot resonances can be obtained. In an example, the cable is a coaxial cable. In general, the cable may be any suitable cable with two signal terminals one of which is coupled to the antenna PCB and the other of which is coupled to the cover. The slot antenna as shown may generate multiband responses. The frequency of the slot antenna may be tuned by adjusting the PCB trace routing. In another example, the frequency bands may be tuned by adjusting the position of the Fed+ or Fed− point based on PCB trace routing.

Figure 10:
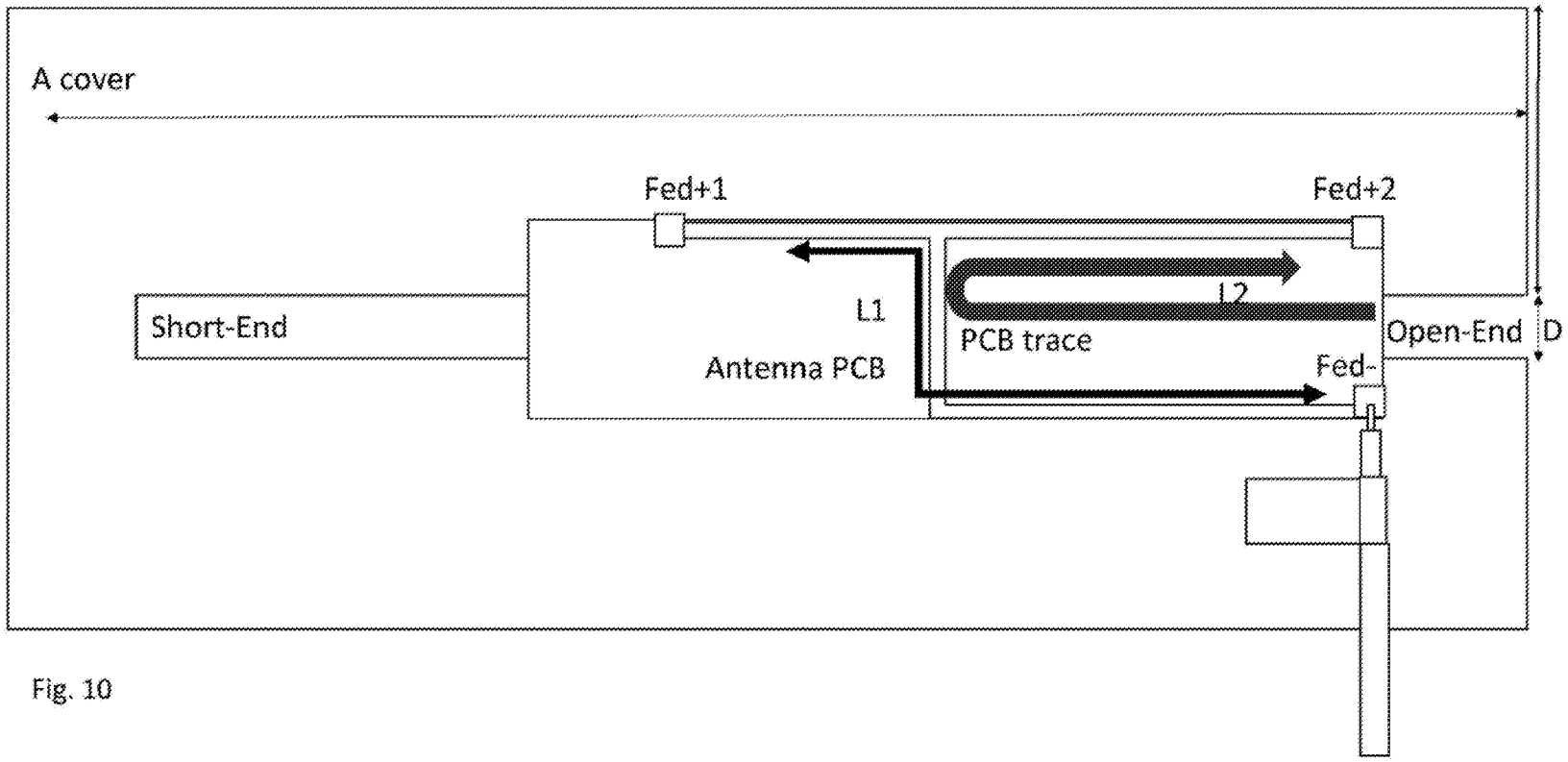
FIG. 10 is a diagram of an example slot antenna according to the disclosure.

FIG. 10 shows a diagram of an example slot antenna according to the disclosure. The example shown by FIG. 10 is similar to the one shown by FIG. 3 except for the PCB trace tracing. The slot antenna in FIG. 3 includes only one positive feeding terminal Fed+. The slot antenna in FIG. 10 includes two positive feeding terminals Fed+1 and Fed+2. In the example, the feeding line 1 and the feeding line 2 share the same first line segment and the second line segment. The third line segment of the feeding line 1 starts from the end of the second line segment and goes toward the left along the top side of the antenna PCB but does not reach the left side of the antenna PCB. The Fed+1 may be located at the end of the third line segment of the feeding line 1. The third line segment of the feeding line 2 starts from the end of the second line segment and then goes toward the right along the top side of the antenna PCB and reaches the right side of the antenna PCB. The Fed+2 is located at the top right-hand corner of the antenna PCB or at a point a distance away from the top right-hand corner. The length of the feeding line 1 starts the Fed− to the Fed+1 and the length of the feeding line 2 starts the Fed− to the Fed+2. In an example, the length L of at least one of the feeding lines 1 and 2 is larger than the width of the slot. In another example, the length of at least one of the feeding lines 1 and 2 is between 5 and 80 times the width of the slot. The Fed− is located at the bottom right-hand corner of the antenna PCB so as to make the antenna PCB coupled with the outer conductor.

Figure 11:
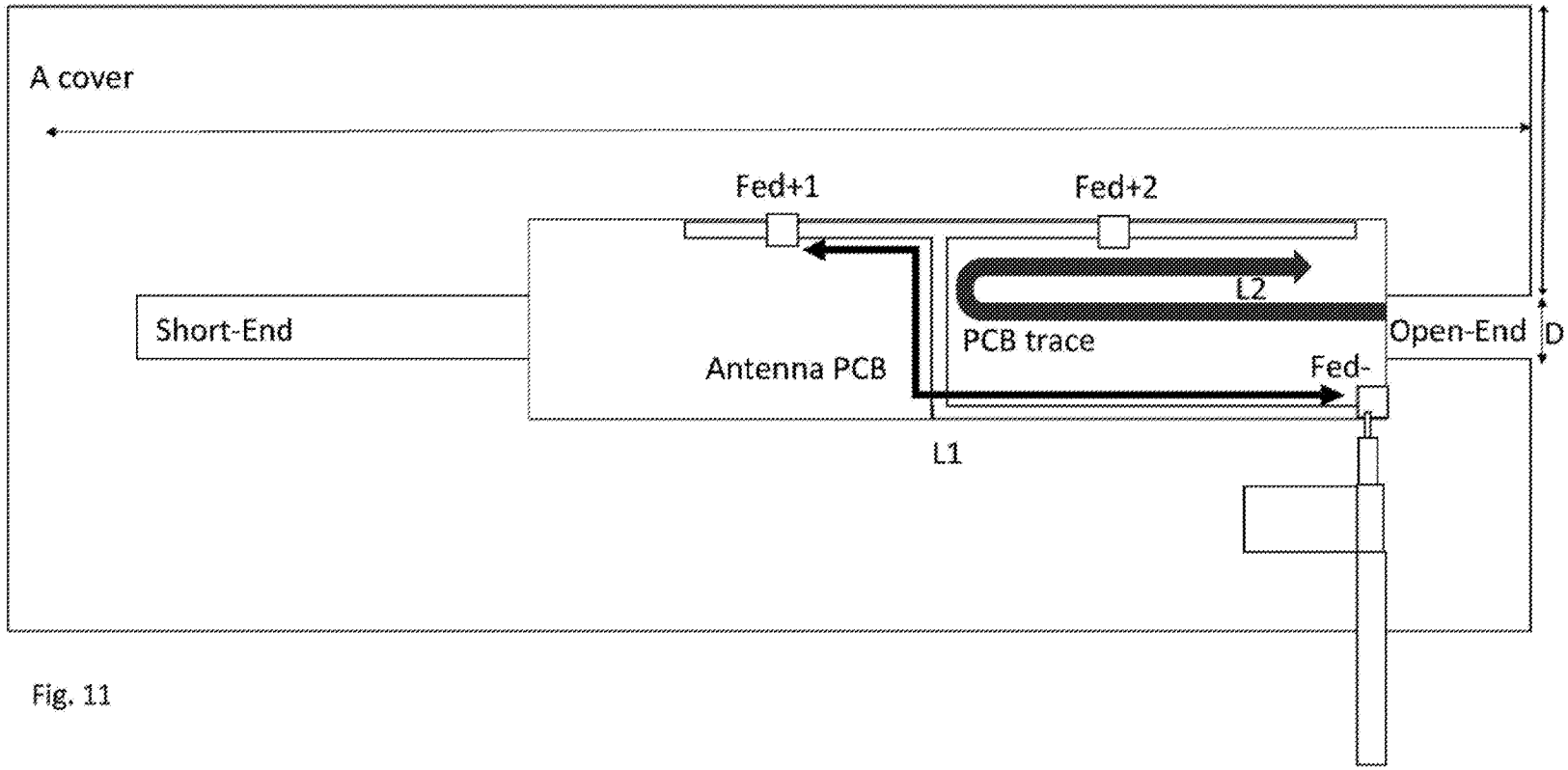
FIG. 11 is a diagram of an example slot antenna according to the disclosure.

FIG. 11 shows a diagram of an example slot antenna according to the disclosure. The example shown by FIG. 11 is similar to the one shown by FIG. 10 except for the PCB trace routing. In the example, the feeding line 1 and the feeding line 2 share the same first line segment and the second line segment. The third line segment of the feeding line 1 starts from the end of the second line segment and goes toward the left but does not reach the left side of the antenna PCB. The Fed+1 is located between the end of the third line segment and the end of the second line segment. The length L of the feeding line 1 starts the Fed− to the Fed+1. In the example, the third line segment of the feeding line 2 starts from the end of the second line segment and goes toward the right but does not reach the right side of the antenna PCB. The Fed+2 of the feeding line 2 is located between the end of the second line segment and the end of the third line segment of the feeding line 2. The length L of the feeding line 2 starts the Fed− to the Fed+2. In an example, the length L of at least one of the feeding lines 1 and 2 is larger than the width of the slot. In another example, the length of at least one of the feeding lines 1 and 2 is between 5 and 80 times the width of the slot. The Fed− is located at the bottom right-hand corner of the antenna PCB so as to make the antenna PCB coupled with the outer conductor.

Figure 12:
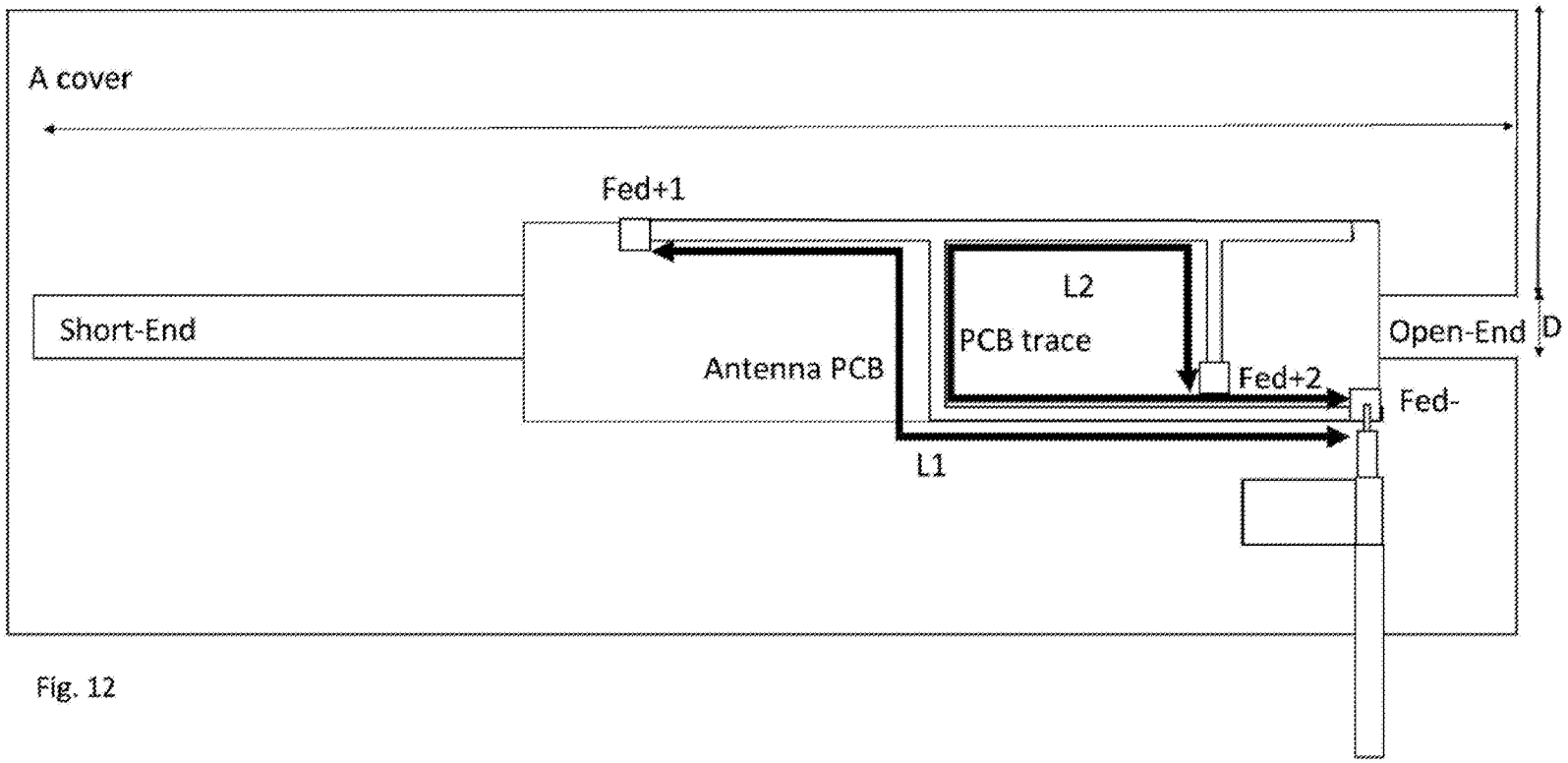
FIG. 12 is a diagram of an example slot antenna according to the disclosure.

FIG. 12 shows a diagram of an example slot antenna according to the disclosure. The example shown by FIG. 12 is similar to the one shown by FIG. 10 except for the PCB trace routing. In the example, the feeding line 1 is the same as the feeding line in FIG. 10. The example shown by FIG. 12 differs from the one shown by FIG. 10 by the feeding line 2. The feeding line 2 further includes the fourth line segment. The fourth line segment starts from a point between the end of the second line segment and the right end of the third line segment and runs downwards the first line segment of the antenna PCB across the slot or partially across the slot. The fourth line segment may be parallel to the second line segment or is titled toward the left or the right. The fed+2 is located at the end of the fourth line segment. The length L of the feeding line 2 starts the Fed− to the Fed+2. The length requirements of the feeding lines 1 and 2 in this example are similar to those in the example shown in FIG. 10.

Figure 13:
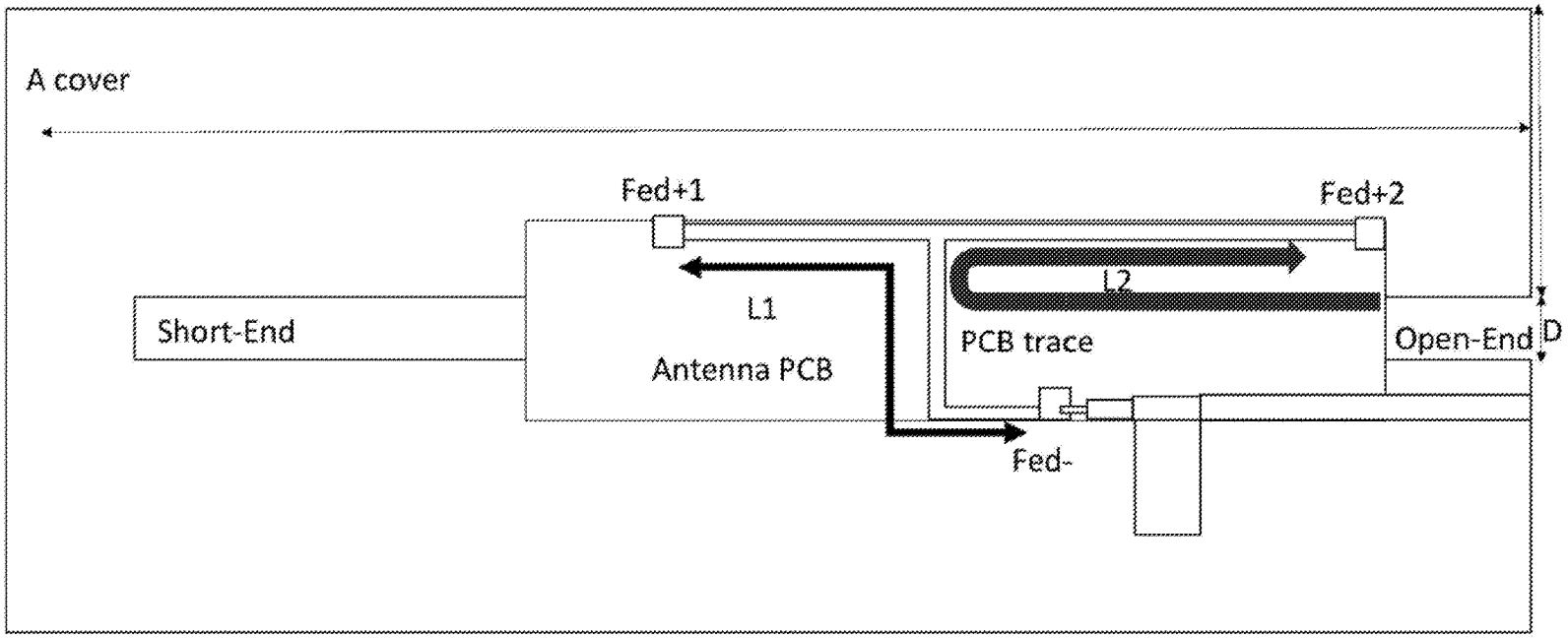
FIG. 13 is a diagram of an example slot antenna according to the disclosure.

FIG. 13 shows a diagram of an example slot antenna according to the disclosure. The example shown by FIG. 13 is similar to the one shown by FIG. 10 except for routing and orientation of the outer conductor. In the example, the outer conductor goes along the bottom side of the antenna PCB from the right side of the antenna PCB and the Fed− is located between the lower end of the second line segment on the bottom side of the antenna PCB and the right side of the antenna PCB. In the example, the length L of the feeding line 1 starts from the Fed− to the Fed+1 and the length L of the feeding line 2 starts the Fed− to the Fed+2. The length requirements of the feeding lines 1 and 2 in this example are similar to those in the example shown in FIG. 10.

Figure 14:
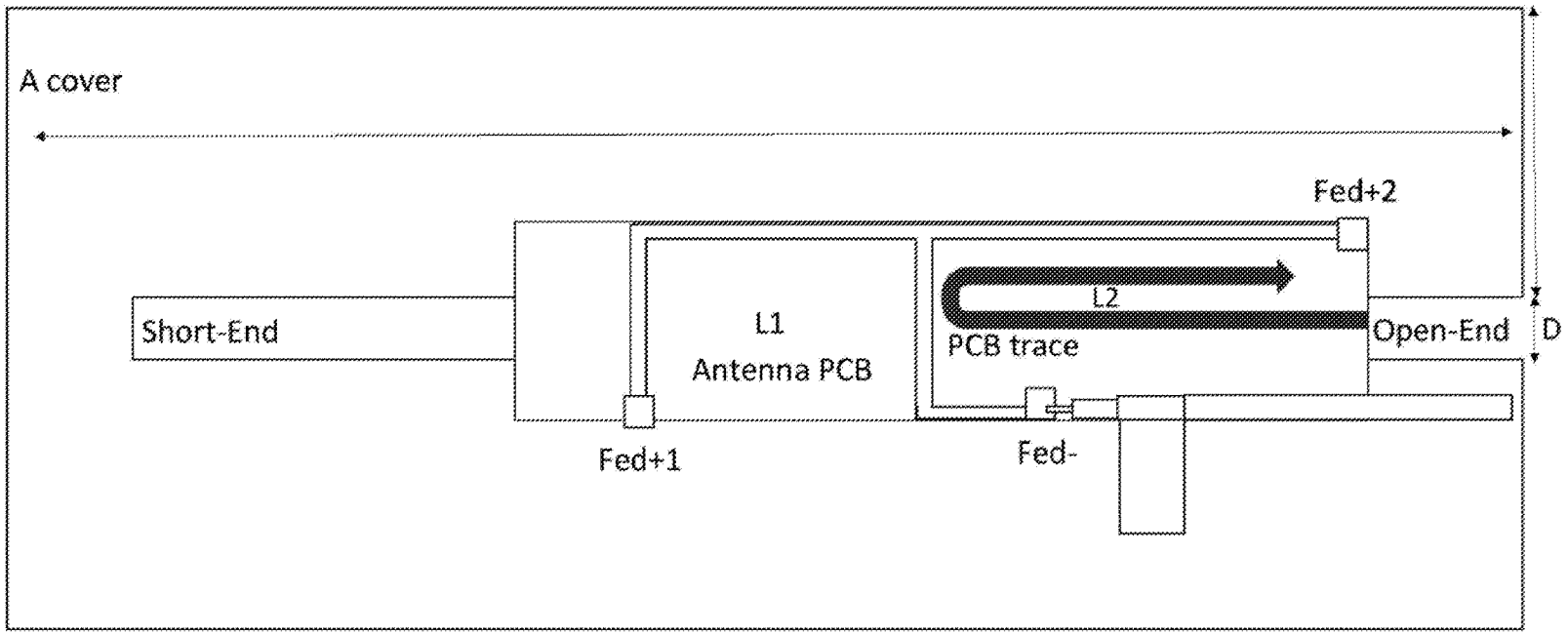
FIG. 14 is a diagram of an example slot antenna according to the disclosure.

FIG. 14 shows a diagram of an example slot antenna according to the disclosure. The example shown by FIG. 14 is similar to the one shown by FIG. 13 except for the PCB trace routing of the feeding line 1. In the example, the feeding line 1 includes the fourth line segment. The fourth line segment starts from the end of the third line segment and runs downwards the bottom side of the antenna PCB across the slot and reaches the bottom side or partially across the slot. The fourth line segment may be parallel to the second line segment. The Fed+1 is located at the end of the feeding line 1 and in the same line as the Fed−. In the example, the length L of the feeding line 1 starts from the Fed− to the Fed+1 and the length L of the feeding line 2 starts from the Fed− to the Fed+2. The length requirements of the feeding lines 1 and 2 in this example are similar to those in the example shown in FIG. 13.

Figure 15:
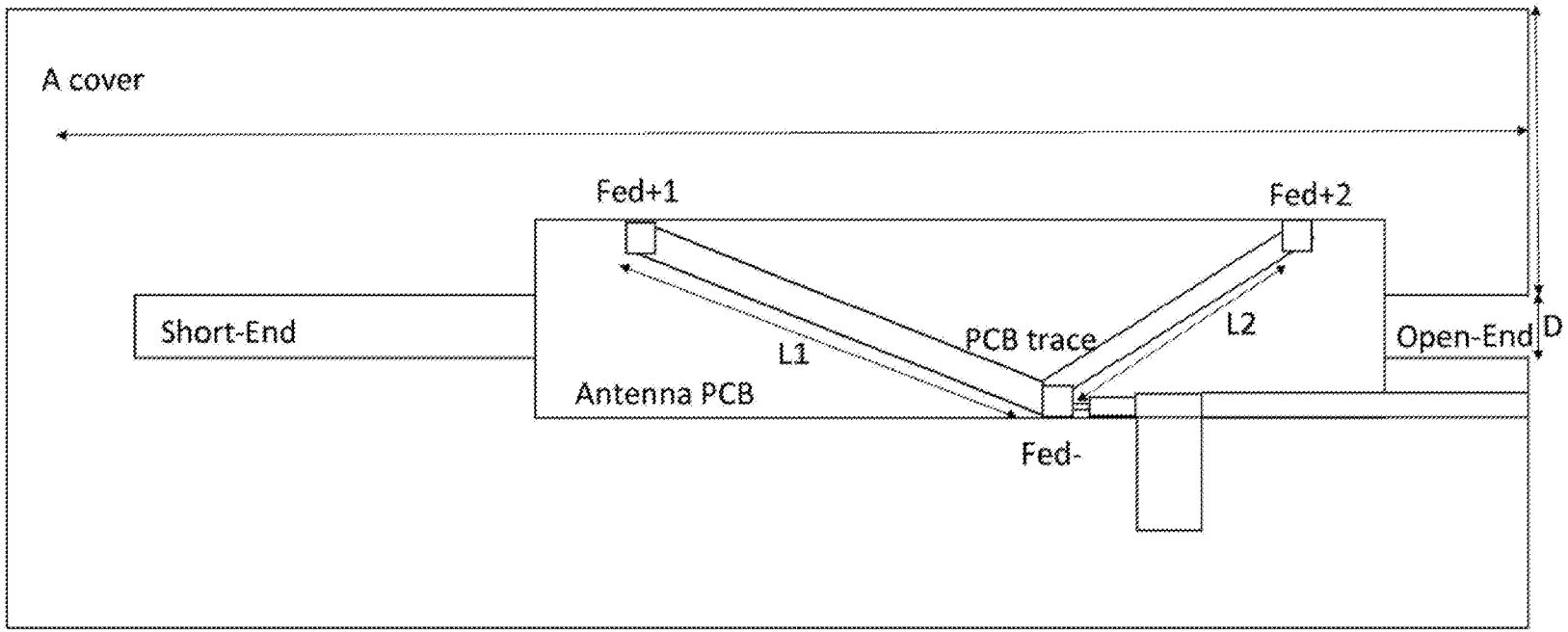
FIG. 15 is a diagram of an example slot antenna according to the disclosure.

FIG. 15 shows a diagram of an example slot antenna according to the disclosure. The example shown by FIG. 15 is similar to the one shown by FIG. 7 except for the PCB trace routing. In the example, the feeding line 1 is a direct line segment from the negative feeding terminal Fed− to the positive feeding terminal Fed+1 across the slot. The fed− is located at the bottom side of the antenna PCB and the Fed+1 is located at the top side of the antenna PCB. The line segment of the feeding line 1 is tilted towards the left from the Fed− by an angle larger than 90° so that the Fed+1 is located at the top side of the antenna PCB and toward the left with respect to the Fed−. The length L of the feeding line 1 starts from the Fed− to the Fed+1. The direct line segment of the feeding line 2 is tilted towards the right from the Fed− by an angle less than 90° so that the Fed+2 is located at the top side of the antenna PCB and toward the right with respect to the Fed−. The length L of the feeding line 2 starts from the Fed− to Fed+2. The length L of at least one of the feeding lines 1 and 2 is larger than the width D of the slot. In another example, the length of at least one of the feeding lines 1 and 2 is between 5 and 80 times the width of the slot.

In one example, the radio frequency multi-bands generated by the slot antenna can be changed by adjusting the routing of the feeding line. In one example, the radio frequency multi-bands generated by the slot antenna can be changed by adjusting the position of at least one of the positive feeding terminals of the feeding lines.

Figure 16:
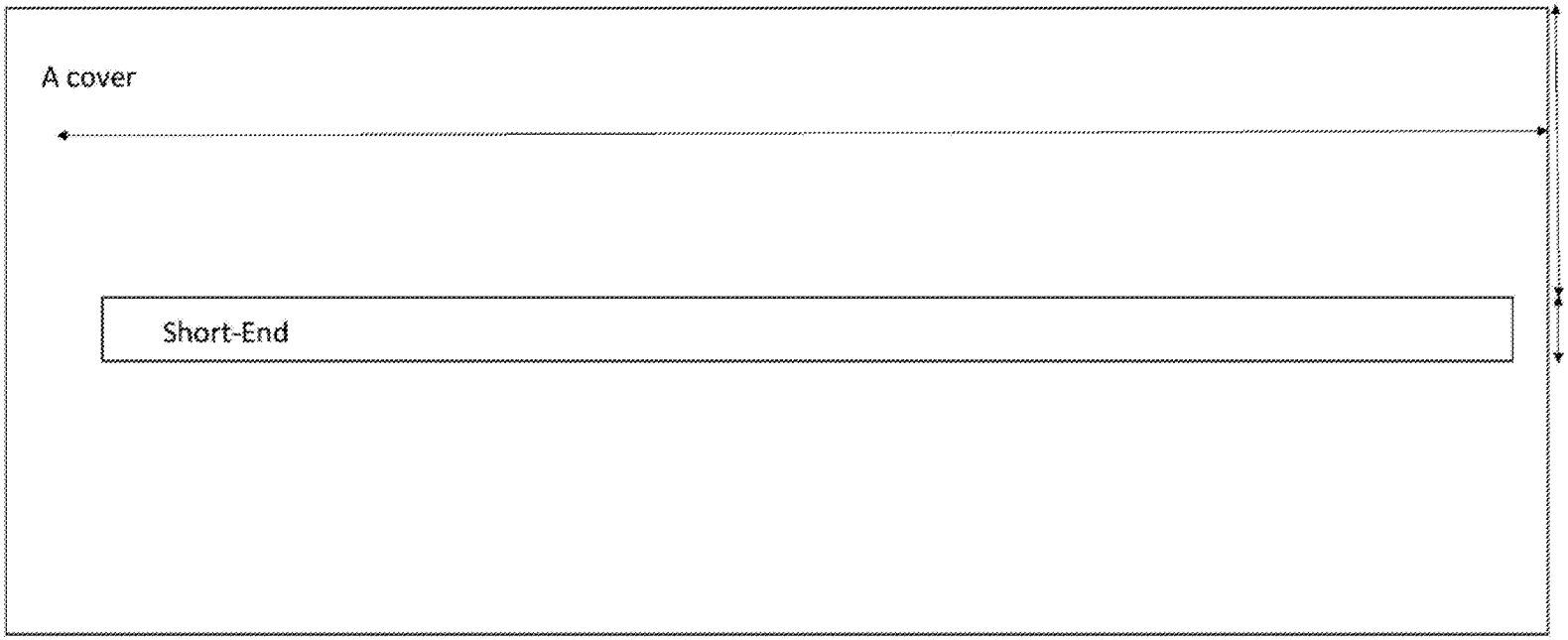
FIG. 16 is a diagram of an example slot antenna according to the disclosure.

FIG. 16 shows a diagram of an example slot antenna according to the disclosure. The preceding examples show the slot antennas wherein the slot of the slot antenna is closed at its one width side within the cover and open at its another width side along the right side of the antenna PCB. The example shown by FIG. 16 shows the slot antenna wherein the slot is closed at both of its width sides within a cover. The slot is located within the cover. The examples with the slot being closed within the cover at both of its sides apply to any other above examples.

The above examples show the slot antennas which include one positive feeding terminal or two positive feeding terminals, but the slot antennas in this disclosure are not limited to the examples of the one or two positive feeding terminals. More feeding lines can be introduced into the example antenna PCB according to the disclosure from the common negative feeding terminal and accordingly more corresponding positive feeding terminals will apply. For the multiple feeding lines, the length of at least one of the feeding lines is larger than the width of the slot. In another example, the length of at least one of the multiple feeding lines is between 5 to 80 times the width of the slot.

Figure 17A:
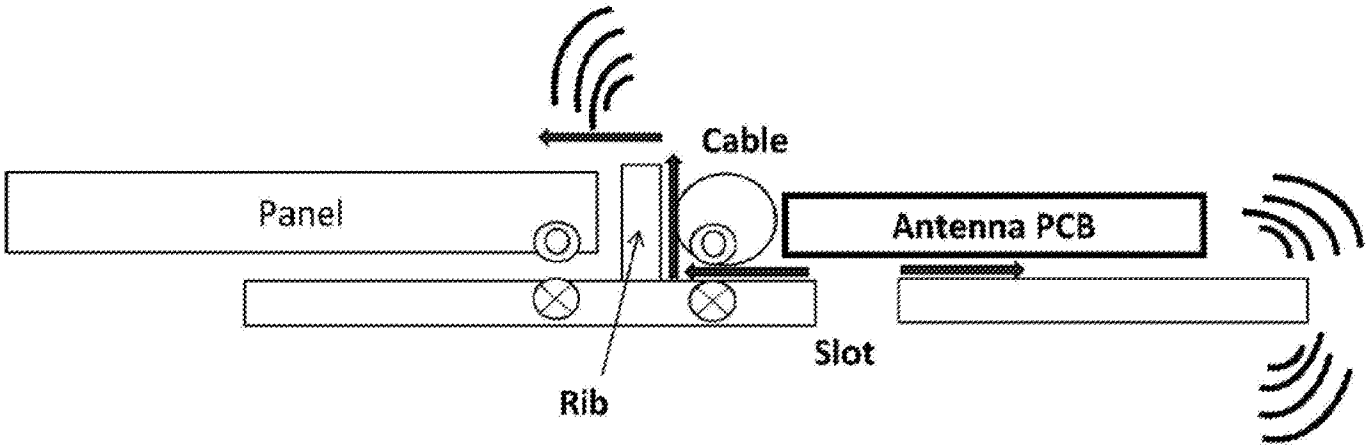
FIG. 17A shows a diagram of an example slot antenna with an example metal rib according to the disclosure.

FIG. 17A shows a diagram of an example slot antenna with an example metal rib according to the disclosure. In the example as shown by FIG. 17A, a metal rib may be vertically disposed on the cover of the slot antenna. In this example, the metal rib may be vertically disposed between a panel and an input/output cable of a device, which installs the slot antenna, so that the radio emission from the slot antenna can propagate upwards along the metal rib and is not blocked by the panel. The term "vertical" in this disclosure may encompass substantially vertical and entirely vertical.

Figure 17B:
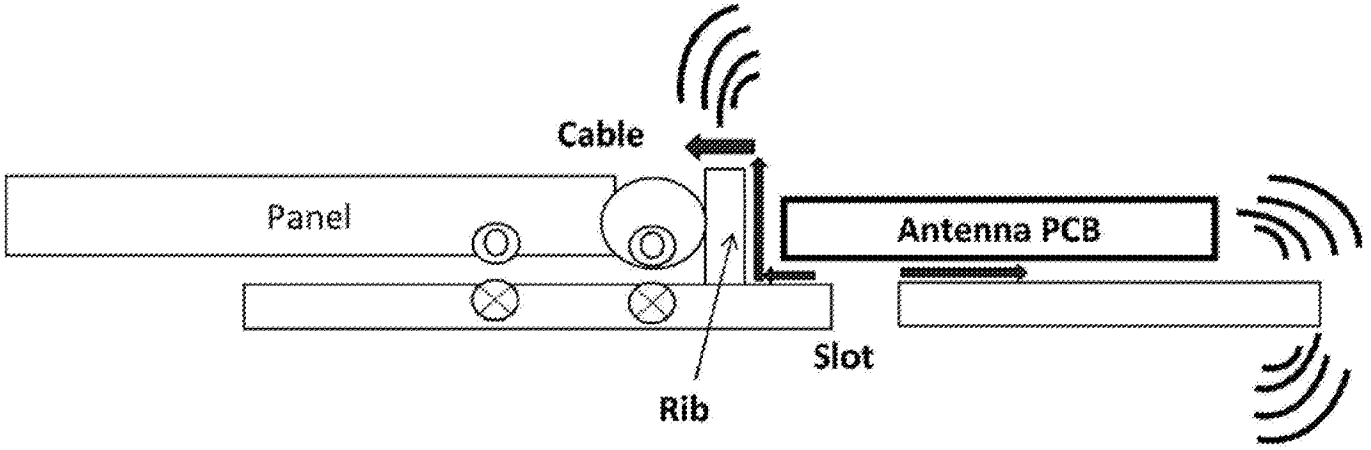
FIG. 17B shows a diagram of an example slot antenna with the example metal rib according to the disclosure.

FIG. 17B shows a diagram of an example slot antenna with the example metal rib according to the disclosure. In the example as shown by FIG. 17B, the metal rib is disposed on the cover of the slot antenna. In this example, the metal rib is vertically disposed between the input/output cable and the antenna PCB on the cover of the slot antenna. In this way, the radio emission from the slot antenna can propagate upwards along the metal rib and is not blocked by the panel and cable.

Applications

The example slot antenna according to the disclosure may find various applications of multiband slot antennas. In an example, the lowest frequency band may start from 704 MHz. In another example, the middle frequency band may be between 1575 to 2170 MHz. In another yet example, the highest frequency band may go up to 2600 MHz. The slot antenna in the disclosure is not limited to these example frequency bands. Different frequency bands can be tuned by adjusting the positions of the positive feeding terminals and/or the PCB trace routing according to the disclosure.

The example slot antennas according to the disclosure can apply to an LTE system, WLAN system or any other system requiring the frequency bands as generated by the slot antenna according to the disclosure.

While the disclosure has been described with respect to a limited number of examples, those skilled in the art, having benefit of this disclosure, will appreciate that other example embodiments can be devised which do not depart from the scope of the disclosure as disclosed herein. All designs with combinations of previous examples earlier should still belong to this disclosure. Single fed, dual and multiple feeding-terminal structures should fall within the spirit and scope of the disclosure as well. Accordingly, the scope of the disclosure should be limited only by the attached claims.

What is claimed:

1. A slot antenna comprising:

a cover including a slot; and an antenna PCB including a first feeding line across the slot, and a second feeding line across the slot;

wherein the antenna PCB is coupled with the cover through a first positive feeding terminal of the first feeding line and through a second positive feeding terminal of the second feeding line, wherein the first positive feeding terminal is distinct from the second positive feeding terminal, and wherein the first feeding line and the second feeding line share a negative feeding terminal;

wherein the slot is closed at its one width side within the cover; and wherein a length of at least one of the feeding lines is larger than a width of the slot.

2. The slot antenna according to claim 1, wherein the slot is open at its another width side along a width side of the cover.

3. The slot antenna according to claim 1, wherein the slot is closed at its another width side within the cover.

4. The slot antenna according to claim 1, wherein the length of the first feeding line is from 5 to 80 times the width of the slot.

5. The slot antenna according to claim 1, wherein the length of the second feeding line is from 5 to 80 times the width of the slot.

6. The slot antenna according to claim 1, wherein routing of the at least one of the feeding lines in the antenna PCB is changed so as to provide different frequency bands.

7. The slot antenna according to claim 1, wherein a position of either the first positive feeding terminal or the negative feeding terminal of the feeding line is changed so as to provide different frequency bands.

8. The slot antenna according to claim 1, wherein the first feeding line is a direct line segment with its first positive terminal and negative feeding terminal being in lines.

9. The slot antenna according to claim 1, wherein the first feeding line is a direct line segment forming an angle with respect to the bottom side of the antenna PCB.

10. The slot antenna according to claim 1, wherein the first feeding line consists of a plurality of the line segments.

11. A slot antenna comprising:

a cover including a slot; and an antenna PCB including a first feeding line across the slot, and a second feeding line across the slot; and a metal rib;

wherein the antenna PCB is coupled with the cover through a first positive feeding terminal of the first feeding line and through a second positive feeding terminal of the second feeding line, wherein the first positive feeding terminal is distinct from the second positive feeding terminal, and wherein the first feeding line and the second feeding line share a negative feeding terminal;

wherein the metal rib is vertically disposed on the cover to facilitate propagation of radio emission generated by the slot antenna; and wherein a length of at least one of the feeding lines is larger than a width of the slot.

12. A slot antenna comprising:

a cover including a slot;

an antenna PCB including a feeding line across the slot; and a metal rib;

wherein the antenna PCB is coupled with the cover through a positive feeding terminal of the feeding line;

wherein the metal rib is vertically disposed on the cover between the antenna PCT and an input/output cable to facilitate propagation of radio emission generated by the slot antenna; and wherein a length of the feeding line is larger than a width of the slot.

13. The slot antenna according to claim 11, wherein the metal rib is disposed between a panel and an input/output cable.

14. The slot antenna according to claim 11, wherein the length of the first feeding line is larger than 5 times the width of the slot.

* * * * *